US009972299B2

(12) United States Patent
Ben-Ami et al.

(10) Patent No.: US 9,972,299 B2
(45) Date of Patent: May 15, 2018

(54) EARPHONE ACTIVE NOISE CONTROL

(71) Applicant: BUGATONE LTD., Tel-Aviv (IL)

(72) Inventors: Edmund Ben-Ami, Beer-Sheva (IL); Noam Petrank, Tel-Aviv (IL)

(73) Assignee: Bugatone Ltd., Tel-Aviv (IL)

( * ) Notice: Subject to any disclaimer, the term of this patent is extended or adjusted under 35 U.S.C. 154(b) by 0 days. days.

(21) Appl. No.: 14/888,601

(22) PCT Filed: May 1, 2014

(86) PCT No.: PCT/IL2014/050394
§ 371 (c)(1),
(2) Date: Nov. 2, 2015

(87) PCT Pub. No.: WO2014/178054
PCT Pub. Date: Nov. 6, 2014

(65) Prior Publication Data

US 2016/0063986 A1 Mar. 3, 2016

Related U.S. Application Data

(60) Provisional application No. 61/818,489, filed on May 2, 2013.

(51) Int. Cl.
*G10K 11/16* (2006.01)
*G10K 11/178* (2006.01)
(Continued)

(52) U.S. Cl.
CPC ..... *G10K 11/178* (2013.01); *H04R 1/1083* (2013.01); *H04R 3/005* (2013.01);
(Continued)

(58) Field of Classification Search
CPC .... H04R 2420/07; H04R 1/1083; H04R 3/04; H04R 1/1016; H04R 29/00;
(Continued)

(56) References Cited

U.S. PATENT DOCUMENTS 4,395,739 A 7/1983 Nakazawa et al.
5,990,784 A * 11/1999 Burnett ..... G08B 3/10 340/384.1
(Continued)

FOREIGN PATENT DOCUMENTS

CN 2162063 4/1994
EP 2202998 6/2010
(Continued)

OTHER PUBLICATIONS

International Search Report and Written Opinion in International Application No. PCT/IL2014/050394, dated Jul. 28, 2014, 9 pages.
(Continued)

*Primary Examiner* — Norman Yu
(74) *Attorney, Agent, or Firm* — Fish & Richardson P.C.

(57) ABSTRACT

A method of active noise reduction. The method comprises instructing a microphone electronically coupled by a client terminal to record a nonaural noise signal, instructing a circuit of the client terminal to record an aural noise signal using at least one electroacoustic transducer of an earphone, calculating a noise reduction signal based on a function combining nonaural noise signal and the aural noise signal, calculating a noise reduced signal based on a combination of a content signal prepared to be played by the at least one electroacoustic transducer and the noise reduction signal, and instructing the circuit to play the noise reduced signal via the at least one electroacoustic transducer. The nonaural noise signal and the aural noise signal are recorded at least partly simultaneously.

34 Claims, 6 Drawing Sheets

(51) Int. Cl.
*H04R 1/10* (2006.01)
*H04R 3/00* (2006.01)
*H04R 5/033* (2006.01)

(52) U.S. Cl.
CPC ..... *G10K 2210/1081* (2013.01); *G10K 2210/3023* (2013.01); *G10K 2210/3214* (2013.01); *H04R 5/033* (2013.01); *H04R 2410/05* (2013.01); *H04R 2420/01* (2013.01); *H04R 2460/01* (2013.01)

(58) Field of Classification Search
CPC ..... H04R 2410/05; H04R 2499/11; H04R 2201/109; H04R 5/033; H04R 5/04; H04R 1/1041; H04R 2430/01; H04R 2460/01; H04R 25/356; H04R 25/55; H04M 1/05; H04M 1/6066; H04M 1/6041; G10K 11/178; G10K 11/1784; G10K 11/175; H04S 3/004; G10L 25/60
USPC ..... 381/56, 74, 57, 58, 71.1, 71.11, 94.4, 381/110, 120, 26, 315, 317, 318; 455/556.1, 63.1, 67.13; 379/430, 447, 379/88.01
See application file for complete search history.

(56) References Cited

U.S. PATENT DOCUMENTS 6,385,261 B1* 5/2002 Tsuji ..... H04B 1/10 375/254
7,065,219 B1 6/2006 Abe et al.
7,359,504 B1 4/2008 Reuss et al.
7,773,759 B2 8/2010 Alves et al.
8,249,265 B2 8/2012 Shumard
8,774,875 B1* 7/2014 Halferty ..... H04R 3/005 379/392
2008/0044036 A1* 2/2008 Konchitsky ..... H04R 3/00 381/71.1
2008/0159555 A1 7/2008 Asada et al.
2009/0003617 A1* 1/2009 Goldman ..... G10K 11/178 381/71.12
2009/0245529 A1 10/2009 Asada et al.
2010/0174390 A1* 7/2010 Garrett ..... H04M 1/0256 700/94
2010/0195842 A1 8/2010 Sibbald et al.
2010/0272276 A1 10/2010 Carreras et al.
2010/0296666 A1 11/2010 Lin
2011/0007907 A1 1/2011 Park et al.
2011/0181452 A1 7/2011 Raifel et al.
2012/0250873 A1* 10/2012 Bakalos ..... G10K 11/178 381/71.6
2013/0177163 A1* 7/2013 Hsiao ..... H04R 3/00 381/71.1
2013/0196721 A1* 8/2013 Waterman ..... H04M 1/05 455/575.2
2013/0208908 A1 8/2013 Theiler et al.

FOREIGN PATENT DOCUMENTS

EP 2314212 4/2011
WO WO2000/10362 2/2000
WO WO2008/096125 8/2000
WO WO2012/167234 12/2012

OTHER PUBLICATIONS

International Preliminary Report on Patentability in International Application No. PCT/IL2014/050394, dated Nov. 3, 2015, 5 pages.
European Search Report in European Application No. 14792178.7, dated Dec. 1, 2016, 4 pages.
Chinese Notification of First Office Action in Chinese Application No. 201480031607.4, dated Mar. 2, 2018, 17 pages (with English Translation).

* cited by examiner

EARPHONE ACTIVE NOISE CONTROL

CROSS-REFERENCE TO RELATED APPLICATION

This application is a National Stage Application under 35 U.S.C. § 371 and claims the benefit of International Application No. PCT/IL2014/050394, filed May 1, 2014, which claims priority to U.S. Application No. 61/818,489, filed May 2, 2013. The disclosure of the foregoing applications are hereby incorporated by reference in their entirety.

BACKGROUND

The present invention, in some embodiments thereof, relates to active noise cancellation/control and, more specifically, but not exclusively, to active noise cancellation/control for headphones based on a combination of aural and nonaural noise signals.

In active noise reduction systems, also known as active noise cancellation/control (ANC) systems, the same loud speakers, in particular loud speakers arranged in the two earphones of headphones, are often used for both noise reduction and reproduction of desirable sound such as music or speech. ANC may be referred to herein as active noise reduction.

Modern ANC is generally achieved through the use of analog circuits or digital signal processing. Adaptive algorithms are designed to analyze the waveform of the background aural or nonaural noise, then based on the specific algorithm generate a signal that will either phase shift or invert the polarity of the original signal. This inverted signal, in anti-phase, is amplified and a transducer creates a sound wave directly proportional to the amplitude of the original waveform, creating destructive interference. This effectively reduces the volume of the perceivable noise.

SUMMARY

According to some embodiments of the present invention, there are provided a method of active noise reduction. The method comprises instructing a microphone electronically coupled by a client terminal to record a nonaural noise signal, instructing a circuit of the client terminal to record an aural noise signal using at least one electroacoustic transducer of at least one earphone, calculating a noise reduction signal based on a function combining the a nonaural noise signal and the aural noise signal, calculating a noise reduced signal based on a combination of a content signal prepared to be played by the at least one electroacoustic transducer and the noise reduction signal, and instructing the circuit to play the noise reduced signal via the at least one electroacoustic transducer. The nonaural noise signal and the aural noise signal are recorded at least partly simultaneously.

Optionally, the at least one electroacoustic transducer is at least one loudspeaker used for playing audio signals of the at least one earphone.

Optionally, the microphone is an integral microphone located in a housing of the client terminal.

Optionally, the aural noise signal includes a plurality of fragments which are recorded intermittently (see FIG. 5).

More optionally, the instructing a circuit comprises instructing the circuit to record the aural noise signal via the at least one electroacoustic transducer in a plurality of recording iterations and intermittently playing the noise reduced signal in a plurality of playing iterations via the at least one electroacoustic transducer so that the plurality of playing iterations are temporarily intertwined with the plurality of recording iterations (see FIG. 5).

More optionally, each fragment of the plurality of fragments lasts less than 3 milliseconds (see FIG. 5).

More optionally, the circuit instructs the at least one electroacoustic transducer to play intermittently the noise reduced signal between each two consecutive fragments of the plurality of fragments (see FIG. 5).

More optionally, the noise reduced signal is played in at least 5 iterations per second (see FIG. 5).

Optionally, the calculating a noise reduction signal comprises estimating a current noise at an aural space according to a phase difference between a fragment of the aural noise signal and a respective fragment of the nonaural noise signal (see FIG. 6).

More optionally, the calculating a noise reduction signal comprises calculating a noise prediction signal based on the current noise and calculating a sound wave with the same amplitude but with an inverted phase of the noise prediction signal (see FIG. 7).

Optionally, the noise reduced signal includes the noise reduction signal and the content signal as different channels which are set to be played simultaneously.

Optionally, the noise reduced signal is a mix of the noise reduction signal and the content signal.

According to some embodiments of the present invention, there are provided a client terminal having a noise reducing functionality. The client terminal comprises a housing, an earphone interface which connects to at least one earphone having at least one electroacoustic transducer, a computerized processor, a microphone which records a nonaural noise signal, and a recording module that instructs a circuit electronically connected to the earphone jack to record an aural noise signal using the at least one electroacoustic transducer. The computerized processor calculates a noise reduced signal based on a combination of a content signal prepared to be played by the at least one electroacoustic transducer and the noise reduction signal and instructs the circuit to play the noise reduced signal via the at least one electroacoustic transducer.

Optionally, the microphone is located in the housing.

More optionally, the microphone is electronically connected to the recording module via the earphone interface.

More optionally, the microphone is part of a headphone which includes the at least one earphone.

Optionally, the earphone interface is an earphone jack.

Optionally, the at least one electroacoustic transducer is arranged in at least one earphone of a headphone.

Optionally, the nonaural and aural noise signals are recorded at least partly simultaneously.

According to some embodiments of the present invention, there are provided an adapter device having a noise reducing functionality. The adapter device comprises a housing, an earphone interface which connects to at least one earphone having at least one electroacoustic transducer, a player device interface, a computerized processor, and a recording module that instructs a circuit electronically connected to the earphone jack to record an aural noise signal using the at least one electroacoustic transducer. The computerized processor calculates a noise reduced signal based on a combination of a content signal prepared to be played by the at least one electroacoustic transducer and the noise reduction signal and instructs the circuit to play the noise reduced signal via the at least one electroacoustic transducer.

According to some embodiments of the present invention, an adapter device is placed between the at least one electroacoustic transducer of the at least one earphone and the player device and used for processing the recorded aural noise signal and calculating the noise reduction signal based on the function that combines the recorded nonaural noise signal and the aural noise signal.

Optionally, the adapter device further comprises a microphone which records a nonaural noise signal.

Optionally, the adapter device further calculates a noise reduced signal based on a combination of the content signal prepared to be played by the at least one electroacoustic transducer and the noise reduction signal.

Optionally, the adapter device provides the noise reduced signal for the playing thereof via the at least one electroacoustic transducer.

Optionally, the adaptor device is integrated into the earphones, producing a noise reducing earphone.

According to some embodiments of the present invention, there are provided a method of active noise reduction. The method comprises instructing a microphone electronically coupled by a adaptor device to record a nonaural noise signal, instructing a circuit of the adaptor device to record an aural noise signal using at least one electroacoustic transducer of at least one earphone, calculating a noise reduction signal based on a function combining the nonaural noise signal and the aural noise signal, calculating a noise reduced signal based on a combination of a content signal prepared to be played by the at least one electroacoustic transducer and the noise reduction signal, and instructing the circuit to play the noise reduced signal via the at least one electroacoustic transducer. The nonaural noise signal and the aural noise signal are recorded at least partly simultaneously.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DETAILED DESCRIPTION

The present invention, in some embodiments thereof, relates to active noise cancellation/control and, more specifically, but not exclusively, to active noise cancellation/control for headphones based on a combination of aural and nonaural noise signals.

According to some embodiments of the present invention, there are provided methods and systems of reducing and/or cancelling noise in one or more earphone(s) connected a client terminal, for example regular unenhanced earphone(s) which are connected to a handheld and/or a wearable computing device. For brevity, reducing and cancelling are used interchangeably.

Figure 5:
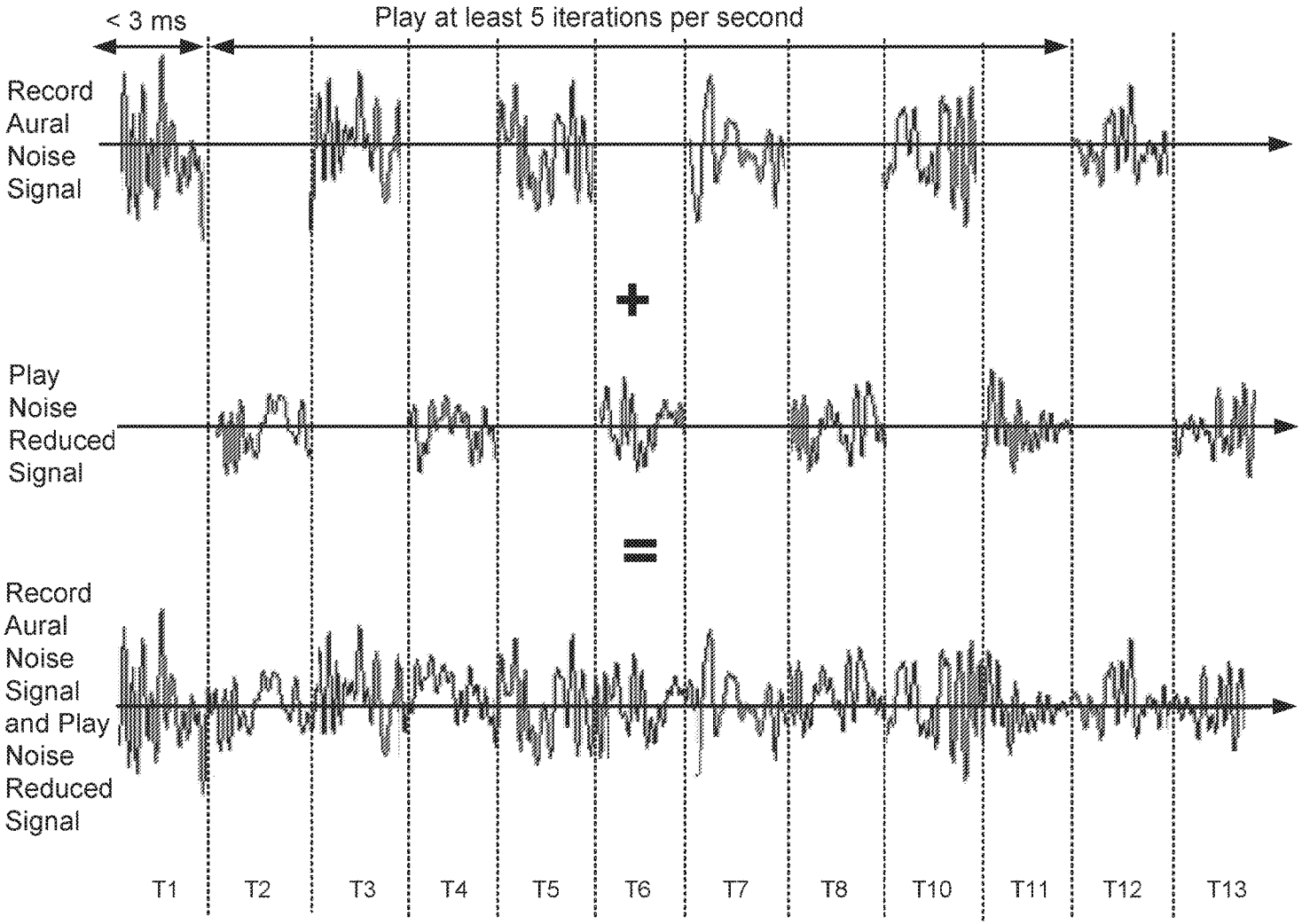
FIG. 5 shows intermittently recording an aural noise signal and playing a noise reduced signal.

The noise reduction is actively calculated based on a current noise analysis of an aural noise signal recorded, optionally intermittently, by electroacoustic transducer(s), such as loudspeakers of the earphone(s), and a nonaural noise signal recorded, optionally continuously, by a microphone of the client terminal, for example an integrated microphone. The aural noise signal is optionally recorded in fragments, intermittently in a plurality of recording iterations, where during the interlude between each pair of consecutive recording iterations a fragment of a noise reduced signal that includes content is played (see FIG. 5).

The noise reduction signal is optionally mixed and/or synchronized with content to create a noise reduced signal. The nonaural noise signal is optionally recorded at a known distance from the earphone(s), for example by a headset microphone.

In some embodiments, the methods and systems allow using an existing hardware of a mobile audio device, such as a Smartphone, a tablet, a wearable computing device, and/or a music player to reduce and/or cancel noise at the aural space without using additional microphone and/or loudspeakers, In such embodiments, a noise reduction application may be installed on existing hardware for performing the noise reduction. For instance, a Smartphone may execute a noise reduction application which instructs an integrated microphone of the Smartphone to receive a nonaural noise signal and a sound card of the Smartphone to intermittently (i) receive fragments of an aural noise signal via an earphone interface(s) of the Smartphone and (ii) play a noise reduced signal calculated using a local processor based on the recorded signals. Similarly, the noise reduction application may be installed on any audio producing computing device.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

Figure 1:
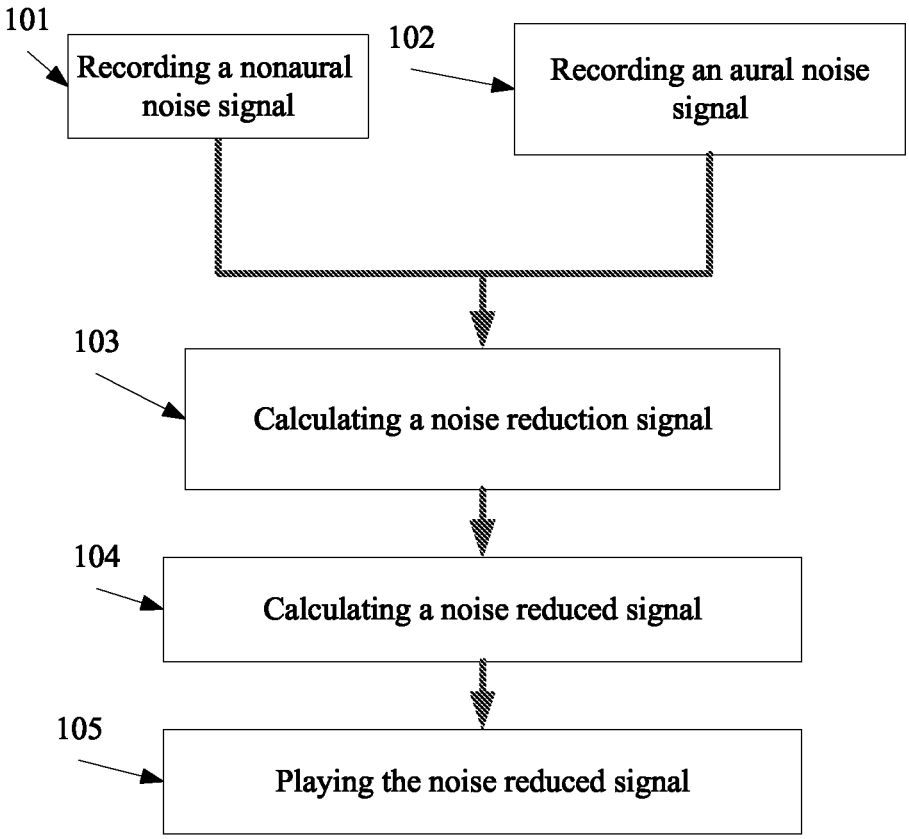
FIG. 1 is a flowchart of a method of actively reducing and/or cancelling unwanted sounds in one or more earphones by combining a nonaural noise signal and an aural noise signal that is recorded using one or more electroacoustic transducers of the earphone(s), according to some embodiments of the present invention.

Reference is now made to FIG. 1, which is a flowchart of a method 100 of actively reducing and/or cancelling unwanted sounds, such as ambient sounds, referred to herein as noise, in one or more earphones, by combining a nonaural noise signal and an aural noise signal which is recorded, optionally intermittently, using one or more electroacoustic transducers of the earphone(s), according to some embodiments of the present invention. As further described below, by combining the nonaural noise signal and the aural noise signal, a noise reduction signal is formed and used to convert a content signal with a certain signal to noise ratio (SNR) to a noise reduced signal with a higher (better) SNR.

As used herein, an aural noise signal is a signal recorded in an ear close surrounding, for example in the space between an ear and an earphone, for instance less than 1, 2, and 3 centimeters (cm) from the ear, for instance less than 0.5 cm from the ear. As used herein, a nonaural noise signal is a signal recorded from a nonaural location, for instance from the close surrounding of a client terminal that is manually held by a wearer of the earphone(s), for example in a range of between 1-2 meters (m) and 10 cm from the ear of the wearer, for instance about 0.8 m from the ear.

The method 100 is optionally executed on a client terminal, for example managed by one or more software and/or hardware modules of the client terminal, for instance an application installed in the memory of a client terminal such as a laptop, a desktop, a cellular phone, an audio player, a Smartphone, a tablet, a wearable computing device, such as Google Goggles™ and/or the like.

Optionally, the aural noise signal includes a plurality of fragments which are recorded intermittently. In such embodiments, the circuit is instructed to record the aural noise signal in a plurality of recording iterations and intermittently playing a noise reduced signal in a plurality of playing iterations via the electroacoustic transducer (see FIG. 5). In such a manner, the playing iterations are temporarily intertwined with the plurality of recording iterations. A fragment may last between about 0.1 and about 30 milliseconds (ms), for example 0.1 ms, 3 ms (see FIG. 5), and 25 ms for instance. Between each pair of recording intervals during which the electroacoustic transducer(s) of the earphone(s) record fragments there is a playing interval during which these electroacoustic transducer(s) play the reduced noise signal. The playing interval, performed during a recording interlude, may last between about 100 and about 10,000 milliseconds (ms), for example 100 ms, 750 ms and 8500 ms for instance.

Figure 2:
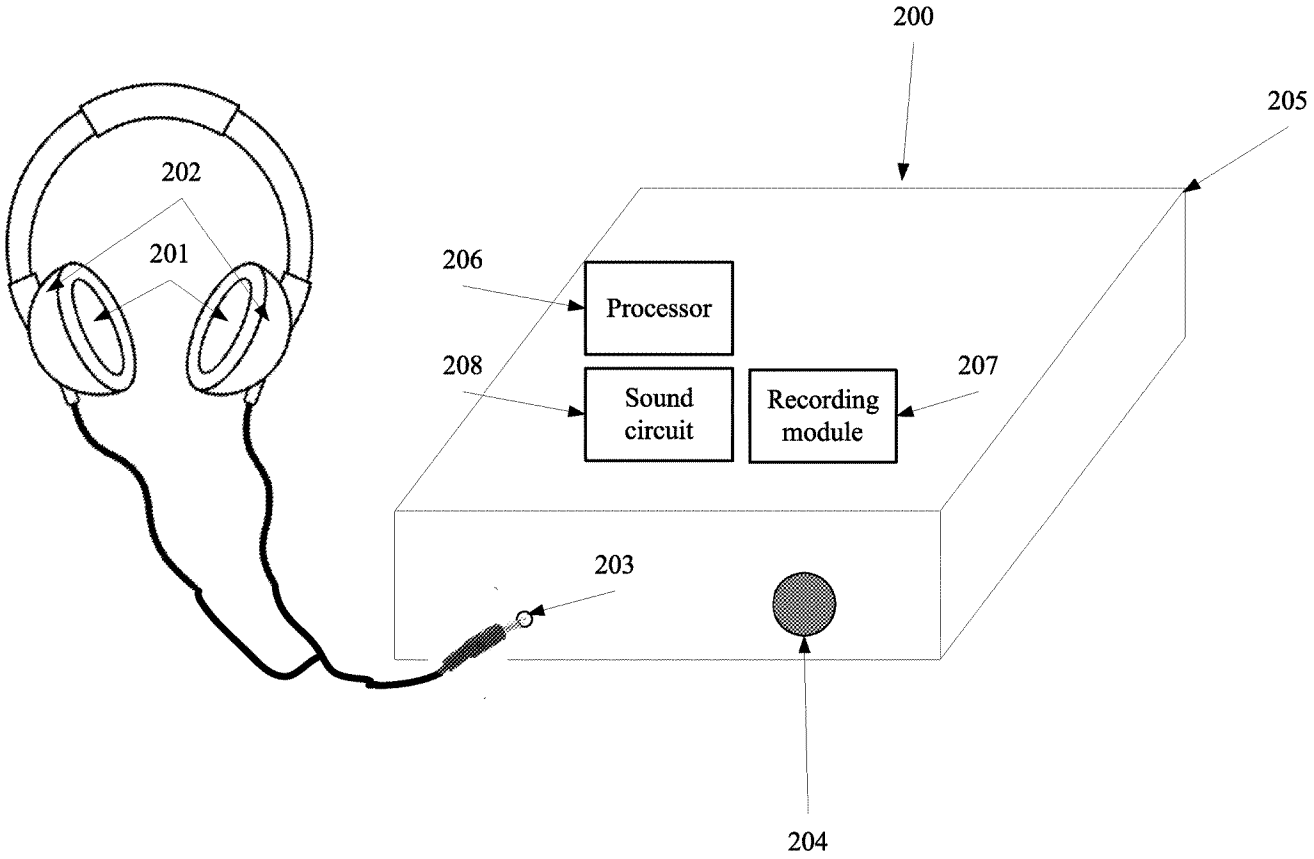
FIG. 2 is a schematic illustration of an exemplary client terminal that reduces noise based on analysis of aural noise signal captured via electroacoustic transducer(s) of earphone(s) connected to the exemplary client terminal via an earphone jack, according to some embodiments of the present invention.

Reference is also made to FIG. 2, which is a schematic illustration of an exemplary client terminal 200 that reduces noise, according to some embodiments of the present invention. The noise reduction is optionally performed based on an analysis of an aural noise signal and a nonaural noise signal. The aural noise signal is captured, optionally intermittently, via one or more electroacoustic transducers 201, for example earphone loudspeakers, of one or more earphones 202 connected to the client terminal 200 via an earphone interface, either wire interface, such as an earphone jack 203 or a wireless interface, such as a Bluetooth™ module. The earphone(s) 202 may be earphones of a headphone or a standalone earphone(s). The nonaural noise signal is captured by one or more microphone(s) 204 of the client terminal 200. The integral microphone(s) 204 optionally includes the integral phone microphone. As used herein, the phrase earphone jack means an earphone female-type socket into which an earphone male-type plug may be inserted to electronically connect the conductors of the sound card to the conductors of the earphone. The earphone jack and plug may comprise two or more conductors, such as a tip-shield 3.5 millimeter type (TS), a tip-ring-shield 3.5 millimeter type (TRS), a tip-ring1-ring2-shield 3.5 millimeter type (TRRS), and the like.

The exemplary client terminal 200 includes a housing 205 that contains the earphone interface 203 and optionally the microphone(s) 204. The housing 205 further contains a local computerized processor 206 and a recording module 207 that instructs a sound circuit 208 electronically connected to the earphone interface 203 to record an aural noise signal using the electroacoustic transducer(s) 201, for example a sound card, a sound controller, a sound circuit, a sound integrated circuit and/or another audio component.

According to some embodiments of the present invention, there is provided an adaptor device which is set to perform recording of an aural noise signal and calculating of a noise reduction signal. The adaptor device may be connected between the earphone jack of a player device and the plug of the earphone. Such an adaptor device may comprise components that perform one or more functions of the player device, and may be connected to a player device. An adaptor device may comprise a computerized processor, a sound circuit, a microphone, a recording module, a player device interface, an earphone interface, and housing. For example, the adaptor device assists in the recording of an aural and/or nonaural noise signal. For example, the adaptor device assists in calculation of a noise reduced signal. For example, an adaptor device comprises an adaptor sound circuit, a universal serial bus (USB) interface to the player device, and a Bluetooth interface to the earphones, and the player device contains software and drivers to instruct the adaptor sound circuit to record an aural signal form the earphone electroacoustic transducer. For example, an adaptor device comprises a computerized processor, an adaptor sound circuit, a TRRS plug interface to the player device, and a TRRS socket interface to the earphones, and the adaptor sound circuit performs all of the functions of the player device described herein. Optionally, the adaptor device is integrated into the earphones to produce noise reducing earphones.

Figure 4:
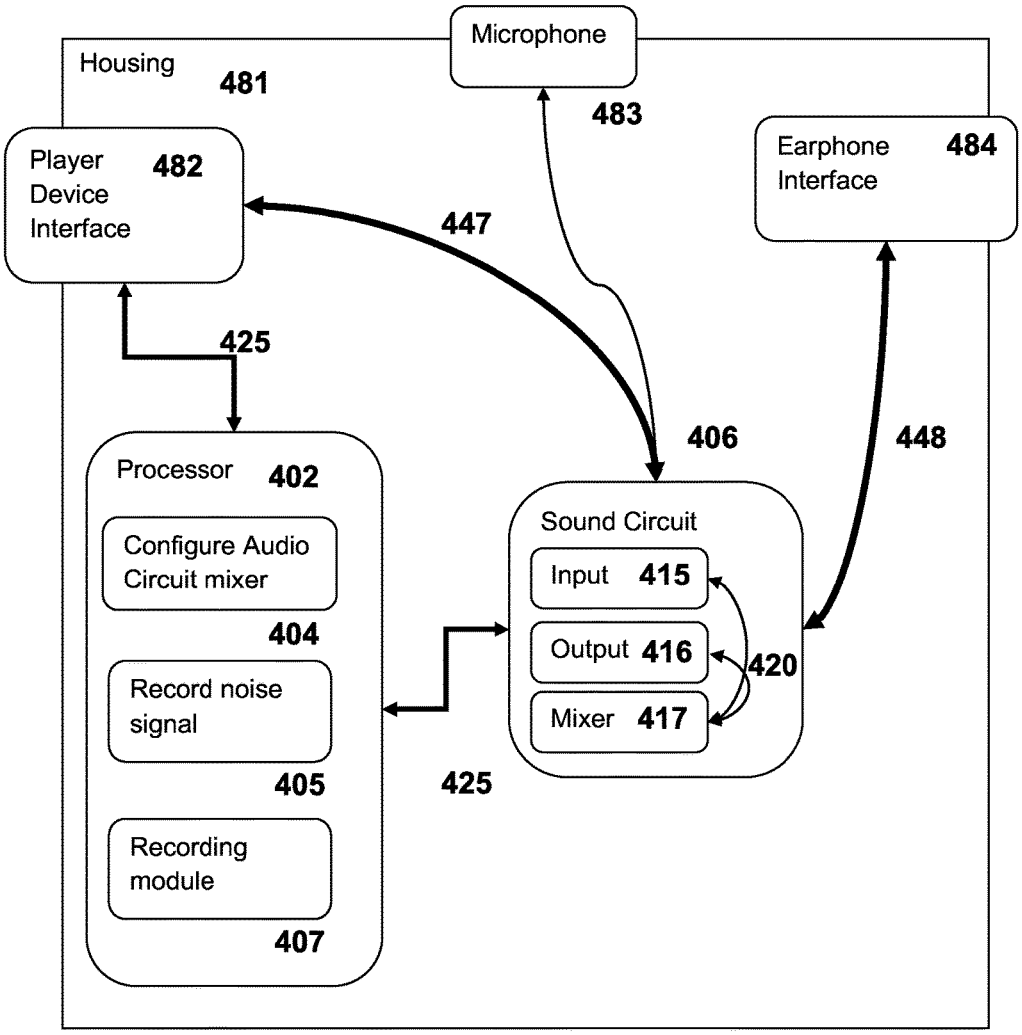
FIG. 4 is a schematic illustration of an exemplary adaptor device comprising a sound circuit that is connected between the exemplary player device and an earphone, according to some embodiments of the present invention.

Reference is also made to FIG. 4, which is a schematic illustration of an exemplary adaptor device comprising a sound circuit that is connected between the exemplary player device and an earphone, according to some embodiments of the present invention. Similar to the description herein of a player device, the adapter device may comprise a housing 481, one or more computerized processors 402, one or more sound circuits 406, a player device interface 482 an earphone interface 484, and optionally a microphone 483. Optionally, the earphone interface 484 is a wireless interface. The processor may be connected to the player device interface 482 and sound circuit 406 with a digital data connection as at 425. For example, a peripheral digital data bus is used as a digital data connection. Optionally, the device comprises a sound circuit but not computerized processors, and the calculating of a noise reduced signal is performed by the player device processor. The sound circuit may comprise an input circuit 415 for recording, and output circuit 416 for audio output, and a mixer 417 for configuring which physical connections are used for input and output. The computerized processor 402 may be configured to instruct the sound circuit 406 to record an aural and/or nonaural noise signal from one or more electroacoustic transducers of the earphones. The processor may be configured as at 404 to send a configuration to the sound circuit mixer 417, telling the sound circuit mixer 417 when the earphone interface 484 is to be connected 421 to the audio input circuit 415, the audio output circuit 416, or both 420. The processor may be configured to record an aural and/or nonaural noise signal 405 using the sound circuit 406. The processor 402 may comprise a recording module 407. The conductors of the earphone interface 484 and the sound circuit 406 may be electronically connected with analog wires 448. The sound circuit 406 may be connected with analog wires 447 to a player device interface 482. The player device interface 482 may connect with a player device using analog signal and/or digital data interfaces, such as universal serial bus, Bluetooth™, earphone analog signal, and the like.

As used herein, the phrase player device means a device that produces analog and/or digital audio content signal to be played on the earphones, such as a client terminal, personal computer, laptop, smartphone, tablet, television, portable compact disk player, portable music player, stereo system, and the like.

The processor instructions described herein may execute on the adaptor device and/or client terminal processors, or may be divided between them.

Optionally, the input and/or output interfaces between the adaptor, the player device, and the earphones are analog and/or digital earphone interfaces, such as a TRRS sockets and/or plugs, USB interfaces, Bluetooth™ interfaces, wireless USB interfaces, and the like.

Optionally, the client terminal and the adaptor device combine resources for producing a noise reduced signal, such as the processor computations of both, the microphones of both for recording nonaural noise signals, the sound card of both for recording and/or mixing, and the like.

As indicated below, the computerized processor 206 may be used to calculate a noise reduced signal based on a combination of a content signal prepared to be played by the electroacoustic transducer(s) 201 and the noise reduction signal and instructs the sound circuit 208 to play the noise reduced signal via the electroacoustic transducer(s) 201. The content signal is optionally an audio signal set to be played to the wearer of the earphone(s) 202, for example an audio track with content such as music, a talk, a recorded sound, a recorded message, a voice of a caller and/or a callee, and/or the like.

Optionally, as depicted in FIG. 2, the client is set to generate a noise reduced signal for the earphone(s) 202 without using any designated microphone. The noise reduced signal is generated using an existing microphone of the client terminal, for example an integrated microphone used for recording a caller and the electroacoustic transducer(s) 201 of the earphones 202. Such a noise reduction model does not require any supporting hardware, such as designated microphones, processors and/or electroacoustic transducers, facilitating an execution of a noise reduction application that generates a noise reduced signal based on an analysis of noise signals captured via simple microphones and unenhanced earphone(s).

Figure 6:
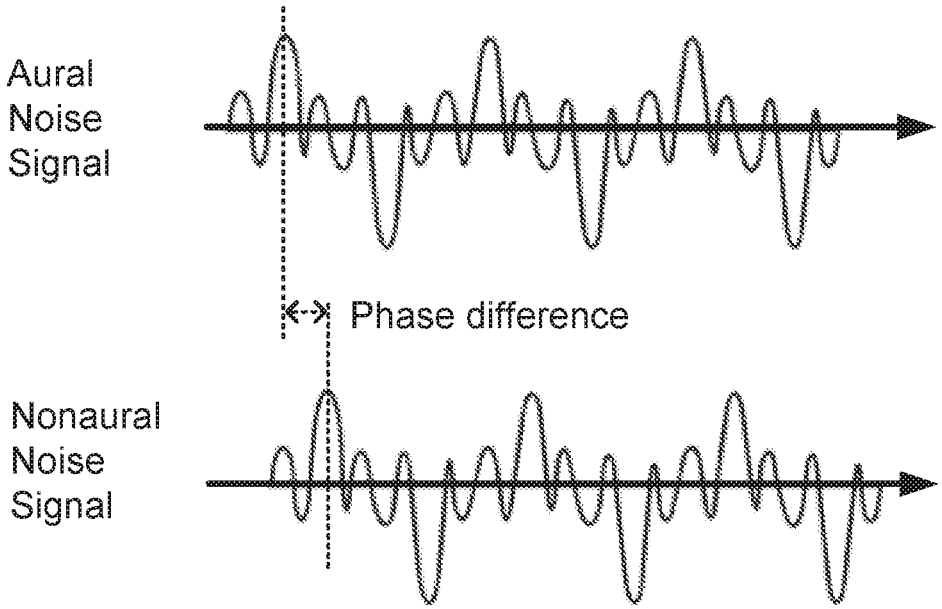
FIG. 6 shows the phase difference between an aural noise signal and a nonaural noise signal.

Reference is now made, once again, to FIG. 1. First, as shown at 101, the microphone(s) 204 are instructed to record a nonaural noise signal. As shown at 102, the sound circuit 208 is instructed by the recording module 207 to record an aural noise signal using the one or more electroacoustic transducers 201. Optionally, the recording of the nonaural noise signal and the aural noise signal is synchronized, for example start and/or end at the same time and/or continuously correlated to facilitate the identification of a phase difference therebetween (see FIG. 6).

This allows the computerized processor 206, as shown at 103, to calculate a noise reduction signal based on a function combining the nonaural noise signal and the aural noise signal, for example a function for calculating an anti noise signal based on a noise prediction made according to a combination of the nonaural noise signal and the aural noise signal.

For example, reference is now made to an exemplary function for calculating a noise reduction signal. For brevity, the following is defined:

- i denotes a microphone;
- $S_i$ denotes a nonaural noise signal sampled by microphone i;
- A denotes a position of electroacoustic transducer(s) of an earphone headphone at the aural space of the wearer;
- $B_i$ denotes a position of microphone (which is different from position A);
- H denotes an aural noise signal sampled by an electroacoustic transducer of an earphone headphone in a plurality of fragments;
- H denotes a fragment of H captured between time $t_r$ and time $p_r$ where r denotes the number of fragments (fragments denoted by H, . . . H);
- Out denotes an estimated noise at position A, namely about the location of the ear of a wearer;
- $c_m$ denotes a constant vector of the electroacoustic transducer(s) 201 when recording H;
- $c_h$ denotes a constant vector of the electroacoustic transducer(s) 201 when playing Out;
- $c_i$ denotes a constant vector of microphone i;
- $e_i$ denotes an echo vector for the nonaural noise signal of microphone i;
- $e_m$ denotes an echo vector for the aural noise signal;
- x denotes an estimate of a pure noise signal originated by a noise source;
- v denotes sets of vectors embodying sparseness conditions on the echo vectors—$e_i$.

The following is used as an input:

$S_1, \ldots S_k$; and where a fragment of H denoted by h (one of the fragments H, . . . , H) and the following is used as an output:

Out.

In this example, the nonaural noise signal $S_i$ is recorded in position $B_i$ where the noise is $e_i$*x and hence $S_i=c_i*e_i*x$. Similarly, the estimated noise in position A is $e_m$*x, and hence the vector H comprises fragments of $c_m*e_m*x$. The vector Out is the vector w s.t $e_m*x=c_h*w$. Out, under mild continuity and sparseness assumptions on ($e_i$) and ($e_m$), may be calculated by solving an optimization problem by various optimization algorithms, for example as described below. As described above, Out is set to be played by the earphone(s), to cancel the noise reaching the ears of the wearer.

The following is a pseudo code of an exemplary function for calculating Out:

for every i, find $T_i=\text{argmin}(\|c_i*T_i-S_i\|^2)$ where each $T_i$ is an estimate of $e_i$*x;

find $F=\text{argmin}(\|c_m*F-h\|^2)$ with h the current fragment of H where F denotes an estimate of the fragments of $e_m$*x;

for every i, find a phase difference between $T_i$ and F, which is the offset $o_i$ such that $$o_i=\text{argmax}<T_i,F>;$$

for every i, set $T_i$=T so that the above signals are aligned;

find the vectors $Q_i$ s.t. $F=Q_i*T_i$ as follows:

$$Q_i=\text{argmin}(\|Q_i*T_i-F\|^2+\|Q_i-Q_i^{old}\|^2+\|vQ_i\|^2+\ldots+\|vQ_i\|^2);$$

find and estimate of an aural noise signal in the ear of a wearer:

$$R=\text{argmin}(\|Q_1*T_i-R\|^2+\ldots+\|Q_1*T_i-R\|^2);$$

find Out as follows: $\text{Out}=\text{argmin}(\|c_h*\text{Out}-R\|^2)$;

where $x=\text{argmin}(\|Ax-b\|^2)$ (i.e. $\text{Out}=\text{argmin}(\|c_h*\text{Out}-R\|^2)$) may be calculated by solving the linear system of equations $A^TAx=A^Tb$, namely $x=(A^TA)^{-1}A^Tb$.

Figure 7:
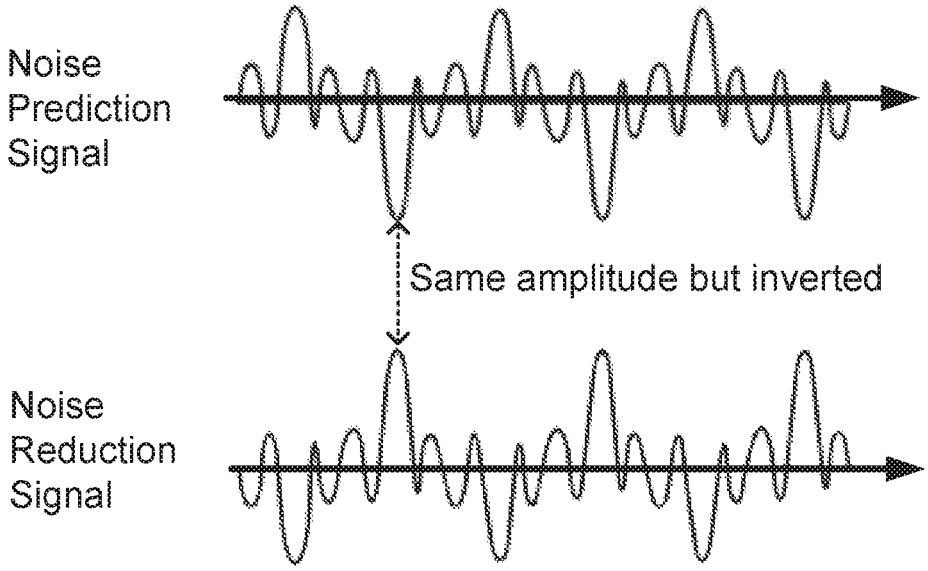
FIG. 7 shows inverting a noise reduction signal that has the same amplitude as a noise prediction signal but is inverted.

The noise reduction signal may be calculated as a sound wave with the same amplitude but with an inverted phase, also referred to as an anti phase, of a noise prediction signal, also referred to herein as a prediction, of the estimate of the current noise at the aural space (i.e. Out) (see FIG. 7).

For example, reference is now made to an exemplary function for calculating a prediction of the noise. For brevity, the following is defined:

- $A_i$ for (i=f, . . . , 100f) denotes a matrix of discrete Fourier transform (DFT) over $Z_i$;
- Pred denotes a prediction of Out in the following f samples.

Pred may be calculated by solving a prediction problem using a prediction algorithm, such as a linear prediction algorithm. For example, the following pseudo-code may be used for finding Pred $$\text{Find Pred}=\text{argmin}(\|A_1(O-O,\text{Pred})\|^2+\ldots+A_{100}(O-O,\text{Pred})\|^2)$$

where the minimization problem is solved as described above. The noise reduction signal is calculated based on Pred, for instance creating an anti noise signal (sound wave) based on the signal of Pred.

Optionally, as shown at 104, a noise reduced signal is calculated based on a combination of a content signal prepared to be played by the electroacoustic transducer(s) 201, such as a music track, and the noise reduction signal. As shown at 105, the noise reduced signal is played by the electroacoustic transducer(s) 201 instead of the content signal. For example, the circuit 208 is instructed to play the noise reduced signal via the electroacoustic transducer(s) 201. The noise reduced signal may combine different channels, one includes the noise reduction signal and other the content signal or originated from a mix of the noise reduction signal and the content signal. Alternatively, the noise reduction signal is played in a synchronized manner with the content signal. In such embodiments, the noise reduction signal has to be played from a supporting electroacoustic transducer that is located in the aural space.

Optionally, before the process depicted in FIG. 1 is performed, a calibration process is performed. For example, the calibration process is performed each time earphone(s) are connected to the earphone interface 203 and/or when new earphone(s) are connected to the earphone interface 203 for the first time. The calibration process may be performed automatically, for example upon detection of a connection of earphones to the earphone interface 203 and/or iteratively and/or when a noise reduction application implementing the process 100 and hosted on the client terminal 200 is activated. The calibration process may be performed manually, for example in response to user instructions, for example using a graphical user interface (GUI) of the noise reduction application. The calibration process estimates a transformation between the signal sent to the earphone(s) and the signal played by them. The estimated transformation defines vectors $c_m$, $c_h$, and/or $c_i$.

Figure 3:
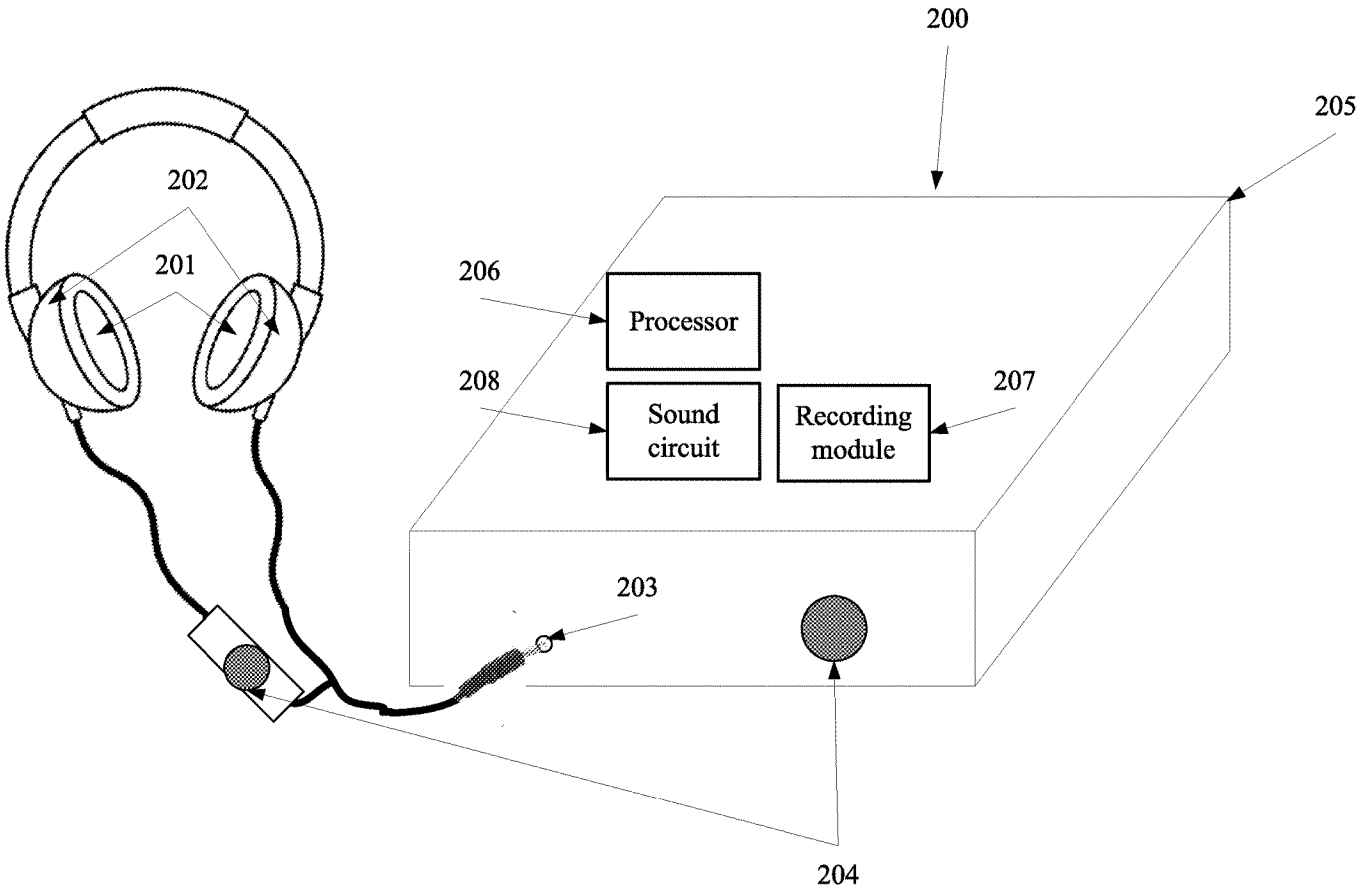
FIG. 3 is a schematic illustration of an exemplary client terminal that reduces noise based on analysis of aural noise signal captured via electroacoustic transducer(s) of earphone(s) connected to the exemplary client terminal and a nonaural noise signal that is captured by microphone(s) of the client terminal, according to some embodiments of the present invention.

Optionally, distance between the position at which the nonaural noise signal is recorded and the position at which the aural noise signal is recorded is known. For example, the nonaural noise signal is recorded from a microphone 304 of a headphone that includes the earphones used for recording the aural noise signal, for example as depicted in FIG. 3. In such embodiments, the corresponding term $\|Q_i*T_i-R\|^2$ in the above exemplary function for calculating an estimated noise is replaced with a constant.

The methods as described above are used in the fabrication of integrated circuit chips.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

It is expected that during the life of a patent maturing from this application many relevant methods and systems will be developed and the scope of the term an earphone, a headphone, a client terminal and a processor is intended to include all such new technologies a priori.

As used herein the term "about" refers to ±10%.

The terms "comprises", "comprising", "includes", "including", "having" and their conjugates mean "including but not limited to". This term encompasses the terms "consisting of" and "consisting essentially of".

The phrase "consisting essentially of" means that the composition or method may include additional ingredients and/or steps, but only if the additional ingredients and/or steps do not materially alter the basic and novel characteristics of the claimed composition or method.

As used herein, the singular form "a", "an" and "the" include plural references unless the context clearly dictates otherwise. For example, the term "a compound" or "at least one compound" may include a plurality of compounds, including mixtures thereof.

The word "exemplary" is used herein to mean "serving as an example, instance or illustration". Any embodiment described as "exemplary" is not necessarily to be construed as preferred or advantageous over other embodiments and/or to exclude the incorporation of features from other embodiments.

The word "optionally" is used herein to mean "is provided in some embodiments and not provided in other embodiments". Any particular embodiment of the invention may include a plurality of "optional" features unless such features conflict.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A method of active noise reduction, comprising:

instructing a microphone electronically coupled by a client terminal or an adaptor device to record a nonaural noise signal;

instructing a circuit of said client terminal or said adaptor device to record an aural noise signal using an electroacoustic transducer of an earphone, wherein said aural noise signal includes a plurality of fragments which are recorded intermittently;

calculating a noise reduction signal based on a function combining said a nonaural noise signal and said aural noise signal;

calculating a noise reduced signal based on a combination of a content signal prepared to be played by said electroacoustic transducer and said noise reduction signal; and instructing said circuit to play said noise reduced signal via said electroacoustic transducer, wherein said instructing said circuit comprises instructing said circuit to record said aural noise signal via said electroacoustic transducer in a plurality of recording iterations and intermittently play said noise reduced signal in a plurality of playing iterations via said electroacoustic transducer, so that each iteration in the plurality of playing iterations is reproduced between two iterations in the plurality of recording iterations, and wherein said nonaural noise signal and said aural noise signal are recorded at least partly simultaneously.

2. The method of claim 1, wherein said electroacoustic transducer is a loudspeaker used for playing audio signals of said earphone.

3. The method of claim 1, wherein:

said microphone is electronically coupled by said client terminal;

said circuit is of said client terminal; and said microphone is an integral microphone located in a housing of said client terminal.

4. The method of claim 1, wherein each fragment of said plurality of fragments lasts less than 3 milliseconds.

5. The method of claim 4, wherein said circuit instructs said electroacoustic transducer to play intermittently said noise reduced signal between each of two consecutive fragments of said plurality of fragments.

6. The method of claim 4, wherein said noise reduced signal is played in at least 5 iterations per second.

7. The method of claim 1, wherein said calculating a noise reduction signal comprises estimating a current noise at an aural space according to a phase difference between a fragment of said aural noise signal and a respective fragment of said nonaural noise signal.

8. The method of claim 7, wherein said calculating a noise reduction signal comprises calculating a noise prediction signal based on said current noise and calculating a sound wave with the same amplitude but with an inverted phase of said noise prediction signal.

9. The method of claim 1, wherein said noise reduced signal includes said noise reduction signal and said content signal as different channels which are set to be played simultaneously.

10. The method of claim 1, wherein said noise reduced signal is a mix of said noise reduction signal and said content signal.

11. A non-transitory computer readable medium comprising computer executable instructions adapted to perform the following operations:

instructing a microphone electronically coupled by a client terminal or an adaptor device to record a nonaural noise signal;

instructing a circuit of said client terminal or said adaptor device to record an aural noise signal using an electroacoustic transducer of an earphone, wherein said aural noise signal includes a plurality of fragments which are recorded intermittently;

calculating a noise reduction signal based on a function combining said a nonaural noise signal and said aural noise signal;

calculating a noise reduced signal based on a combination of a content signal prepared to be played by said electroacoustic transducer and said noise reduction signal; and instructing said circuit to play said noise reduced signal via said electroacoustic transducer, wherein said instructing said circuit comprises instructing said circuit to record said aural noise signal via said electroacoustic transducer in a plurality of recording iterations and intermittently play said noise reduced signal in a plurality of playing iterations via said electroacoustic transducer, so that each iteration in the plurality of playing iterations is reproduced between two iterations in the plurality of recording iterations, and wherein said nonaural noise signal and said aural noise signal are recorded at least partly simultaneously.

12. A client terminal having a noise reducing functionality, comprising:

a housing;

an earphone interface which connects to an earphone having an electroacoustic transducer;

a computerized processor;

a microphone which records a nonaural noise signal; and a recording module that instructs a circuit electronically connected to said earphone interface to record an aural noise signal using said electroacoustic transducer, wherein said aural noise signal includes a plurality of fragments which are recorded intermittently;

wherein said computerized processor is configured to:

(i) calculate a noise reduction signal based on a function combining said nonaural noise signal and said aural noise signal, (ii) calculate a noise reduced signal based on a combination of a content signal prepared to be played by said electroacoustic transducer and said noise reduction signal, and (iii) instruct said circuit to play said noise reduced signal via said electroacoustic transducer, wherein said instructing said circuit comprises instructing said circuit to record said aural noise signal via said electroacoustic transducer in a plurality of recording iterations and intermittently play said noise reduced signal in a plurality of playing iterations via said electroacoustic transducer, so that each iteration in the plurality of playing iterations is reproduced between two iterations in the plurality of recording iterations.

13. The client terminal of claim 12, wherein said microphone is located in said housing.

14. The client terminal of claim 12 wherein said microphone is electronically connected to said recording module via said earphone interface.

15. The client terminal of claim 14, wherein said microphone is part of a headphone which includes said earphone.

16. The client terminal of claim 12, wherein said earphone interface is an earphone jack.

17. The client terminal of claim 12, wherein said electroacoustic transducer is arranged in the earphone of a headphone.

18. The client terminal of claim 12, wherein said nonaural and aural noise signals are recorded at least partly simultaneously.

19. An adaptor device having a noise reducing functionality, comprising:

a housing;

an earphone interface which connects to an earphone having an electroacoustic transducer;

a computerized processor;

a recording module that instructs a circuit electronically connected to said earphone interface to record an aural noise signal using said electroacoustic transducer, wherein said aural noise signal includes a plurality of fragments which are recorded intermittently; and a player device interface;

wherein said adaptor device is placed between said electroacoustic transducer of said earphone and a player device;

wherein said computerized processor is configured to:

(i) calculate a noise reduction signal based on a function combining a nonaural noise signal which is recorded by a microphone and said aural noise signal, (ii) calculate a noise reduced signal based on a combination of a content signal prepared to be played by said electroacoustic transducer and said noise reduction signal, and (iii) instruct said circuit to play said noise reduced signal via said electroacoustic transducer, wherein said instructing said circuit comprises instructing said circuit to record said aural noise signal via said electroacoustic transducer in a plurality of recording iterations and intermittently play said noise reduced signal in a plurality of playing iterations via said electroacoustic transducer, so that each iteration in the plurality of playing iterations is reproduced between two iterations in the plurality of recording iterations.

20. The adaptor device of claim 19, wherein said adaptor device further comprises said microphone which records said nonaural noise signal.

21. The adaptor device of claim 19, wherein said adaptor device provides said noise reduced signal for a playing thereof via said electroacoustic transducer.

22. The adaptor device of claim 19, wherein said adaptor device is integrated into said earphone, producing a noise reducing earphone.

23. The method of claim 1, wherein:

said microphone is electronically coupled by said client terminal; and said circuit is of said client terminal.

24. The method of claim 1, wherein:

said microphone is electronically coupled by said adaptor device; and said circuit is of said adaptor device.

25. A method, comprising:

recording a nonaural noise signal with a microphone;

recording an aural noise signal with an electroacoustic transducer in a plurality of recording iterations;

generating a first signal by combining the nonaural noise signal and the aural noise signal;

generating a second signal by combining the first signal with a content signal; and playing the second signal with the electroacoustic transducer in a plurality of playing iterations, so that each iteration in the plurality of playing iterations is reproduced between two iterations in the plurality of recording iterations.

26. The method of claim 25, wherein each iteration in the plurality of recording iterations lasts less than 3 milliseconds.

27. The method of claim 25, wherein the second signal is played in at least 5 iterations per second.

28. The method of claim 25, wherein generating the first signal comprises estimating a current noise at an aural space according to a phase difference between an iteration of the aural noise signal and a respective iteration of the nonaural noise signal.

29. The method of claim 28, wherein generating the first signal comprises calculating a third signal based on the current noise at the aural space and calculating a sound wave with the same amplitude but with an inverted phase of the third signal.

30. An electronic system, comprising:

an electroacoustic transducer to record an aural noise signal;

a computerized processor;

a microphone to record a nonaural noise signal; and a computer readable medium comprising computer executable instructions that, when executed, cause the computerized processor to perform operations that include:

(i) record the aural noise signal in a plurality of recording iterations, (ii) generate a first signal by combining the nonaural noise signal and the aural noise signal, (iii) generating a second signal by combining the first signal with a content signal, and (iv) playing the second signal with the electroacoustic transducer in a plurality of playing iterations, so that each iteration in the plurality of playing iterations is reproduced between two iterations in the plurality of recording iterations.

31. The electronic system of claim 30, wherein recording the aural noise signal includes recording each iteration in the plurality of recording iterations for less than 3 milliseconds.

32. The electronic system of claim 30, wherein playing the second signal includes playing the second signal in at least 5 iterations per second.

33. The electronic system of claim 30, wherein generating the first signal comprises estimating a current noise at an aural space according to a phase difference between an iteration of the aural noise signal and a respective iteration of the nonaural noise signal.

34. The electronic system of claim 33, wherein generating the first signal comprises calculating a third signal based on the current noise at the aural space and calculating a sound wave with the same amplitude but with an inverted phase of the third signal.

* * * * *